United States Patent [19]

Omori et al.

[11] 4,205,197

[45] May 27, 1980

[54] INDUCTION FURNACE OF GRAPHITE CRUCIBLE

[75] Inventors: Tsuguharu Omori; Michio Kawasaki, both of Kawasaki, Japan

[73] Assignee: Fuji Electric Co., Ltd., Kanagawa, Japan

[21] Appl. No.: 964,297

[22] Filed: Nov. 28, 1978

[30] Foreign Application Priority Data

Dec. 2, 1977 [JP] Japan ..... 52-160884

[51] Int. Cl.[2] ..... H05B 5/12

[52] U.S. Cl. ..... 13/27; 266/242; 266/275

[58] Field of Search ..... 266/166, 242, 275; 13/26, 27, 32

[56] References Cited

U.S. PATENT DOCUMENTS

| | | | |
|---|---|---|---|
| 1,748,706 | 2/1930 | Esmarch | 13/27 |
| 1,818,107 | 8/1931 | Taylor | 13/27 |
| 1,840,247 | 1/1932 | Northrup | 266/242 |
| 1,922,034 | 8/1933 | Feehan | 13/26 |
| 1,963,481 | 7/1934 | Willcox | 13/27 |
| 2,782,475 | 2/1957 | Wilhelm et al. | 266/275 |
| 3,036,888 | 5/1962 | Lowe | 13/26 |
| 3,677,332 | 7/1972 | Smiernow | 266/242 |
| 3,901,999 | 8/1975 | Landis et al. | 13/26 |
| 3,998,264 | 12/1976 | Hocking | 266/242 |

*Primary Examiner*—L. Dewayne Rutledge
*Assistant Examiner*—John P. Sheehan

[57] ABSTRACT

An induction furnace in which a graphite crucible is encompassed by a spaced thermal insulating sheath. The annular space therebetween is sealed and a coil is circumferentially mounted about the sheath. The crucible thus constructed is placed on a furnace bed which is provided with a conduit for discharging the molten metal therein.

5 Claims, 4 Drawing Figures

INDUCTION FURNACE OF GRAPHITE CRUCIBLE

BACKGROUND OF THE INVENTION

This invention relates to an induction furnace employing a graphite crucible and more particularly to an improvement in an air-insulated furnace structure.

Hitherto, furnaces of a back-lining type and a coil-cementing type as shown in FIGS. 1 and 2 respectively have been generally known as the induction furnace using the graphite crucible.

The induction furnace of the back-lining type as shown in FIG. 1 is formed of a graphite crucible GC, the outer periphery and the bottom of which is applied with a back-lining BL of a refractory material which is in turn circumferentially mounted with a coil C. The induction furnace of the coil-cementing type as shown in FIG. 2 is constituted in such a way that the graphite crucible GC is surrounded by a coil cement GC which is spaced to provide an insulating space. The coil cement CC is circumferentially mounted with a coil C.

In considering the arrangements, either type of the known induction furnaces back-lining or coil cement of relatively large thickness are required resulting in a lower power factor and efficiency. Further, in the known induction furnace since the back-lining and the coil cement have a high thermal conductivity, the high heat transfer from the graphite crucible to the coil is proportionally enlarged with a disadvantageous high heat dissipation throughout the furnace. In particular, the furnace of the coil-cementing type is subjeced to the extremely high heat dissipation because the insulating space is opened to the outer atmosphere. The back-lining type, on the other hand, has a disadvantage in presenting great difficulty in renewal of the refractory. Furthermore, the conventional induction furnaces using a graphite crucible is not provided with appropriate safety measures for discharging molten metal out of the furnace upon leakage of the molten metal.

As a result of every endeavor to overcome all of the disadvantages hereinbefore described and to obtain an conveniently construction and highly safe induction furnace of high performance, the inventors have provided a novel furnace having many advantages such as convenient operation and maintenance, less heat dissipation, improved electric characteristic and excellent thermal insulation in which the graphite crucible is surrounded by an air space defined by the thermal insulation sheath on which is in turn mounted with a coil. The graphite crucible with its bottom is placed on a furnance bed through an interposed thermal insulating material and the bottom of the air to space is closed. A thermal insulating wedge is releasably mounted on an outer periphery of the upper open end of the graphite crucible in order to completely seal the air space.

The furnace bed for supporting the graphite crucible is preferably provided in which an opening with a detecting sensor is located through which the molten metal is discharged. The opening is ordinarily closed by a blank plate of material which is combustible upon contact with the molten metal so that the molten metal leaked through the air phase may be discharged out of the furnace together with an accurate detection of the leakage of the molten metal by the sensor which ensures an enhancement of the safety of the induction furnace.

SUMMARY OF THE INVENTION

A general object of the invention is to provide an induction furnace using a graphite crucible of simple construction with improved thermal insulation and electric characteristic and having improved safety and convenience in operation.

In accordance with the invention, there is provided an induction furnace using a graphite crucible in which the graphite crucible is surrounded by a thermal insulating sheath spaced therefrom to provide an air space. A coil is circumferentially mounted about the sheath and the graphite crucible thus constructed is placed on a furnace bed which is provided with an opening to communicate with the air space for discharging the molten metal. An annular seal comprising a wedge member is releasably mounted around an outer periphery of the upper open end of the graphite crucible so that the air space is sealed and so that replacement of the graphite crucible may conveniently be performed.

In the induction furnace according to the invention, the thermal insulating sheath is preferably a multi-layered structure with the coil member encircling through the outermost insulating material material layer.

Further in the induction furnace according to the invention, the furnace bed is provided with one or more openings for discharging the molten metal in which a sensor is arranged to detect any leakage of the molten metal. The openings are preferably provided with a plug of a blank plate of a material which is combustiblewhen contacted with the molten metal.

For a fuller understanding, the invention will be described more in detail in the following with reference to the accompanying drawings, in which:

DESCRIPTION OF THE PREFERRED EMBODIMENTS

Figure 1:
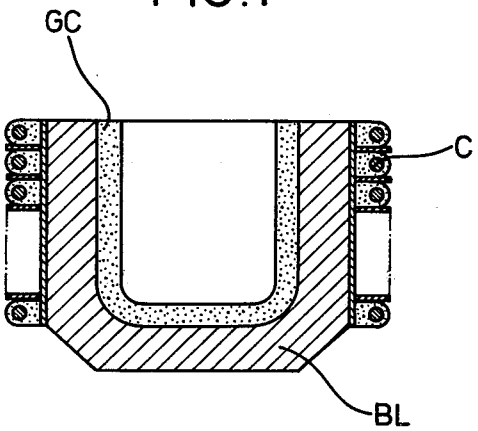
FIG. 1 is a sectional view of the conventional induction furnace of graphite crucible.
Figure 2:
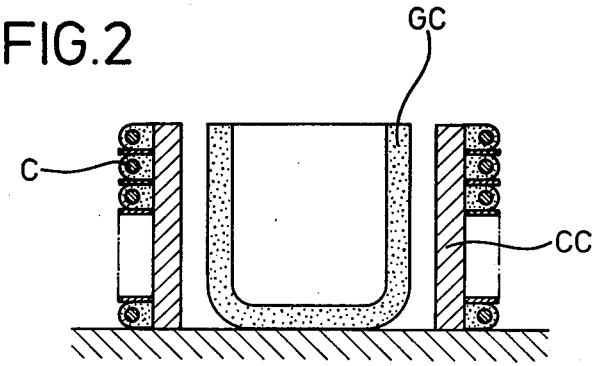
FIG. 2 is a sectional view similar to FIG. 1 but showing another structure of the thermal insulation layer.
Figure 4:
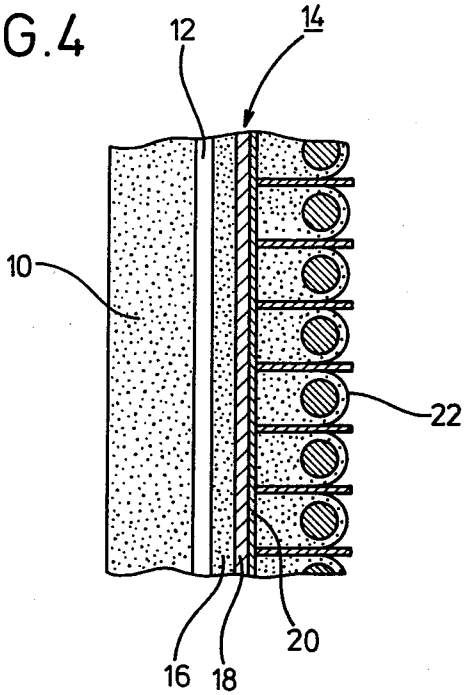
FIG. 4 is a fragmentarily enlarged sectional view of the thermal insulating layer of the furnace of FIG. 3.
Figure 3:
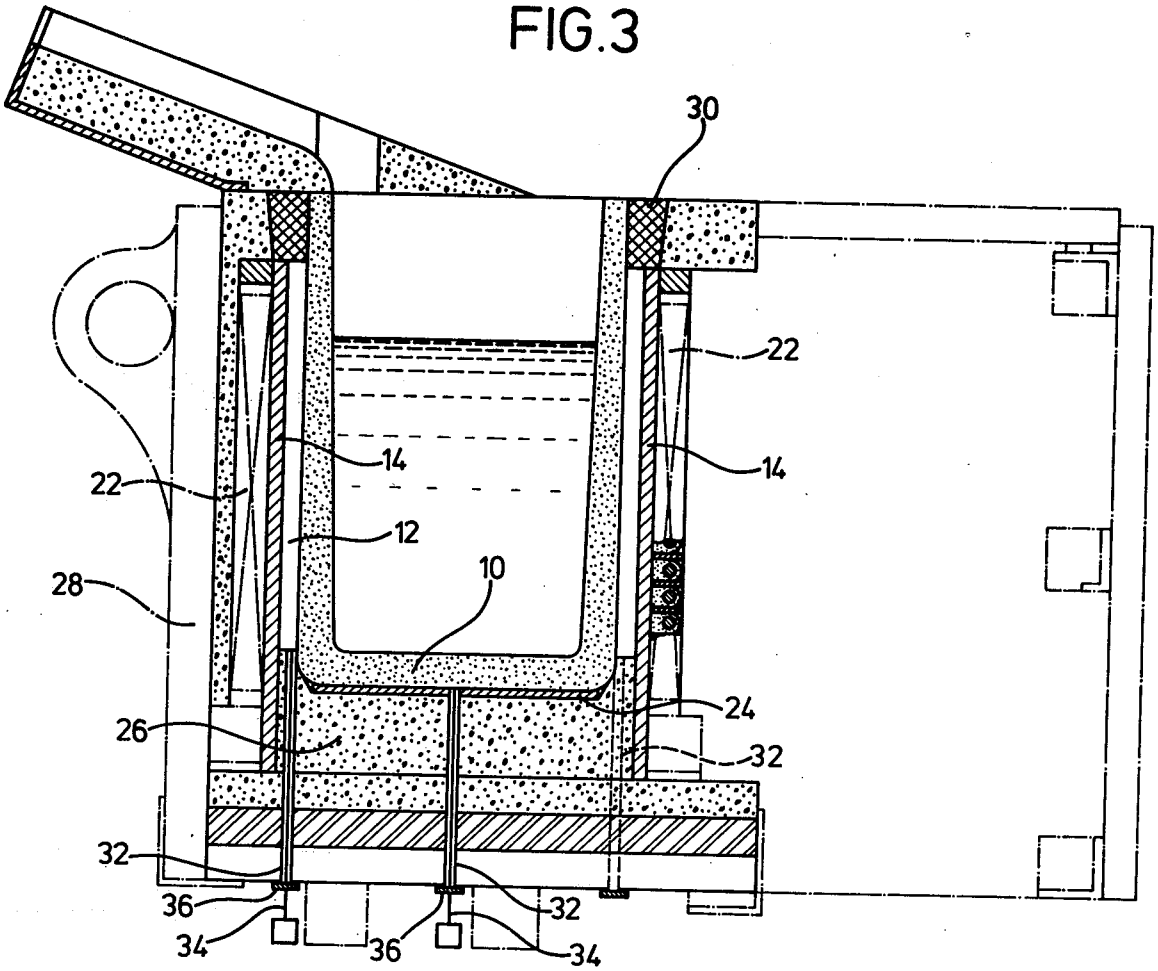
FIG. 3 is a sectional view of one embodiment of the induction furnace of graphite crucible according to the invention.

In FIG. 3, a graphite crucible 10 is surrounded by a thermal insulating material 14 with a space 12 forming an insulating layer an air space. The insulating layer as generally shown in FIG. 4 is constituted by a multi-layered structure which includes a first thermal insulating material 16 encompassing the space 12 and a second thermal insulating material 18 which is in turn surrounded by an insulating material 20 in which a coil member 22 is mounted. The bottom of the graphite crucible 10 is covered with a layer of thermal insulating material and is placed on a furnace bed 26. Thus, it will be appreciated that the air space 12 formed around the grahite crucible 10 is closed at its bottom end. The induction furnace of the graphite crucible thus constructed is carried by a furnace wall 28 to provide a tilting furnace.

As best shown in FIG. 3, in the top end of the air space 12 is removably inserted a thermal insulating wedge member 30 for sealing the air space 12.

The air space 12 thus formed ensures a convenient replacement of the graphite crucible 10 and prevents heat dissipation thus enhance the electric characteristics, the power factor and efficiency with a minimum power consumption and also prevents the molten metal leaked when the graphite crucible 10 is accidentally cracked from contacting with the coil member 22 to avoid the burning loss of the thermal insulating layer.

The furnace bed 26 for carrying the graphite crucible is provided with one or more openings 32 which communicate with the air space 12 for discharging the molten metal therethrough. In the opening 32 is arranged a sensor 34 for detecting any leakage of the molten metal and also provided with a blank plate 36 of a material which is combustible upon contact with the molten metal. An opening 32 is preferably provided in the center of the furnace bed 26 so as to pass through the thermal insulating material. As hereinbefore described, the opening 32 is normally closed by the blank plate 36 to have the air phase 12 sealed for obtaining a complete thermal insulation and heat-retaining effect. Upon leakage of the molten metal, the sensor 34 is adapted to actuate means for discharging the molten metal out of the furnace, which ensures the safety of the furnace.

In the induction furnace according to the invention, since the thermal insulating layer surrounding the graphite crucible is constituted with an air space and a thermal insulating thin material of high thermal resistivity, the distance between the graphite crucible and the coil member may be minimized while the power factor and the efficiency increased. Further, the sealed air space ensures an effective thermal insulation between the crucible and the coil member thereby reducing the power consumption by efficient heat retention. Thus it will be appreciated that the induction furnace according to the invention has an advantage of less power consumption but of high melting rate and a high energy efficiency.

Moreover, the air space arranged as a part of the thermal insulating layer ensures a convenient replacement of the graphite crucible and refreshment of the thermal insulating material. Further, the positive detection of the leakage of the molten metal also ensures the quick discharge of the molten metal from the furnace, establishing certainty in operation with safety.

The foregoing should be considered as descriptive and not limitative as many changes and modifications may be made therein without departing from the spirit of the invention.

What is claimed is:

1. An induction furnace comprising a supporting housing having a furnace bed and surrounding furnace walls, a graphite crucible located within said housing in upright position, a thermal insulated outer sheath having a height less than said furnace wall and surrounding said crucible, a coil wound about the exterior of said sheath, said crucible and said sheath being mounted on said furnace bed spaced from each other to define an annular air space therebetween closed at its bottom end and open at its upper end, a removable seal for closing the upper end of said air space comprising an annular member having a wedge shaped cross section insertible between the inner periphery of said furnace wall and the outer periphery of said crucible and having a frontal edge adapted to seat on the upper end of said thermal sheath, and at least one conduit extending through the furnace base in communication with said air space for the removal of molten metal therefrom.

2. The induction furnace according to claim 1 including sensing means responsive to the passage of a molten metal through said conduit to provide a signal thereof.

3. The induction furance according claim 1 or 2 including a plug closing said conduit and combustible upon contact with the molten metal to permit discharge of said molten metal.

4. The induction furnace according to claim 6 wherein said insulating sheath is formed of an assembly of at least two layers of thermal insulating material and said coil is embedded in the outer most layer of said assembly.

5. The induction furnace according to claim 6 including a layer of insulating material interposed between the bottom of said crucible and said furnace bed, and a conduit extending through said furnace bed and said interposed layer of thermal material for the discharge of molten metal therethrough.

* * * * *